US010398199B2

(12) United States Patent
Hollaus

(10) Patent No.: US 10,398,199 B2
(45) Date of Patent: Sep. 3, 2019

(54) SHOE STUFFING DEVICE

(71) Applicant: Olivia Y. Hollaus, Boca Raton, FL (US)

(72) Inventor: Olivia Y. Hollaus, Boca Raton, FL (US)

( * ) Notice: Subject to any disclaimer, the term of this patent is extended or adjusted under 35 U.S.C. 154(b) by 0 days.

(21) Appl. No.: 15/840,788

(22) Filed: Dec. 13, 2017

(65) Prior Publication Data

US 2018/0220745 A1 Aug. 9, 2018

Related U.S. Application Data

(60) Provisional application No. 62/433,562, filed on Dec. 13, 2016.

(51) Int. Cl.
*A43D 3/14* (2006.01)
*A43B 19/00* (2006.01)

(52) U.S. Cl.
CPC ..... *A43D 3/14* (2013.01); *A43B 19/00* (2013.01); *A43D 3/1433* (2013.01); *A43D 3/1441* (2013.01)

(58) Field of Classification Search
CPC ..... A43D 3/14; A43D 3/1433
USPC ..... 12/114.2, 128 R
See application file for complete search history.

(56) References Cited

U.S. PATENT DOCUMENTS 896,536 A * 8/1908 Hayden ..... A43D 3/1491 12/114.2
1,725,516 A * 8/1929 Hirshon ..... A43D 3/1441 12/116.8
1,853,896 A * 4/1932 Enrich ..... A43D 3/1441 12/114.2
1,866,018 A * 7/1932 De Witt ..... A43D 3/1441 12/116.8
2,039,261 A * 4/1936 Reinhardt ..... A43D 3/1441 12/128 R
2,670,482 A * 3/1954 Roman ..... A43D 3/1441 12/128 R (Continued)

FOREIGN PATENT DOCUMENTS

CH 347732 7/1960
GB 2444021 5/2008

OTHER PUBLICATIONS

Vintage Shoe Forms, Only for Me Jewelry, Internet Article, http://www.etsy.com/listing/269015123/vintage-shoe-forms-hand-made-with-metal, retrieved Jun. 3, 2016.

(Continued)

*Primary Examiner* — Marie D Bays
(74) *Attorney, Agent, or Firm* — McHale & Slavin, P.A.

(57) ABSTRACT

A shoe stuffing device is provided. The shoe stuffing device includes a shoe stuffing device body having a distal end and a proximal end and an aperture formed close to the proximal end. The aperture provides a handle for the user to grasp or insert the finger into and pull the shoe stuffing device out of the shoe, while helping resist vertical expansion and support lateral compressibility of the body. The shoe stuffing device can also include a decorative element at the proximal end and attached to the top loop. The decorative element not only provides a pleasant aesthetic effect, but also indicates to the user that the end having the decorative element is to remain outward while the opposite end or tip is to be inserted into the shoe.

13 Claims, 20 Drawing Sheets

(56) References Cited

U.S. PATENT DOCUMENTS

| | | | | | |
|---|---|---|---|---|---|
| 2,975,444 | A * | 3/1961 | Drew | A43D 3/1441 | 12/128 R |
| 3,131,036 | A * | 4/1964 | Hirschberg | A43D 3/1408 | 12/128 B |
| 3,200,427 | A * | 8/1965 | Daley | A43D 3/1408 | 12/128 R |
| 4,069,531 | A | 1/1978 | Streich | | |
| 4,261,071 | A | 4/1981 | Forte | | |
| 4,497,080 | A * | 2/1985 | Inspector | A43D 3/1416 | 12/128 R |
| 5,291,669 | A | 3/1994 | Khoury et al. | | |
| 6,378,224 | B1 * | 4/2002 | Qualkinbush | A43B 3/0026 | 34/104 |
| 8,826,480 | B1 * | 9/2014 | Lyles | A43D 3/08 | 12/114.2 |
| 2005/0241081 | A1 * | 11/2005 | Nadler | A43D 3/04 | 12/114.4 |
| 2009/0031507 | A1 | 2/2009 | McChesney | | |
| 2011/0240691 | A1 | 10/2011 | Miller et al. | | |

OTHER PUBLICATIONS

Black Satin Pointy Toe Shoe Stuffers, Internet Article, http://www.giftsden.com/gutzees-black-satin-pointy-toe-shoe-stuffers.html, retrieved Jun. 3, 2016.

Shoe Stuffers, Internet article, http://lavendergreen.com/shop/shoe-stuffers/, retrieved Jul. 3, 2016.

* cited by examiner

SHOE STUFFING DEVICE

RELATED APPLICATIONS

In accordance with 37 C.F.R. 1.76, a claim of priority is included in an Application Data Sheet filed concurrently herewith. Accordingly, the present invention claims priority to U.S. Provisional Patent Application No. 62/433,562, entitled "SHOE STUFFING DEVICE", filed Dec. 13, 2016. The contents of which the above referenced application is incorporated herein by reference.

FIELD OF THE INVENTION

This invention relates generally to the field of shoe accessories, and more particularly, to a shoe stuffing device that can be placed in a shoe to maintain the form of the shoe and can also provide decorative features.

BACKGROUND OF THE INVENTION

Shoes typically need more care than just replacing the laces, or polishing them occasionally. A person's feet sweat throughout the day; there are about 250,000 sweat glands in a pair of feet. All those sweat glands produce about a half pint of perspiration every day. In such an enclosed environment, this moisture is absorbed by the shoe material, leading to the deterioration of the inside of the shoe, such as cracking and becoming misshapen. This causes the shoe to become unwearable, and will need to be disposed of. Nicer shoes, such as those made of leather, are even more at risk for such problems. Fortunately, there are ways to help slow down the corrosion of the shoe.

One way to absorb the moisture and maintain the shoes' form is to stuff the shoes with tissue paper, or similar stuffing, when the shoes are not in use. However, tissue paper stuffing or inserts can get flat and shred very quickly, losing their ultimate purpose of maintaining the shoes' form.

A shoe tree, or shoe stuffer, is a device that allows a shoe to hold its proper shape by being inserted inside the shoe to allow the shoe to maintain its form. If the shoe tree is made of proper materials, it will also slow the damage from perspiration by wicking away, or absorbing, the moisture from the shoe material.

Shoe trees are a pair of foot-shaped devices, usually constructed of plastic, metal, or wood that are placed in a shoe to maintain its shape when not being worn. However, some shoe trees are constructed from durable paper products, though are usually only designed for temporary use.

U.S. Pat. No. 4,069,531 discloses an orthopedic shoe tree for the shoes of a person with a foot or toe deformity having a front stretching part and a rear heel part. The front stretching part has two separate front foot halves between which a stretching wedge fits whereby the halves may be forced apart by movement of the stretching wedge. The rear heel part and front stretching part are connected by loose articulation.

U.S. Pat. No. 4,261,071 discloses a shoe tree which has been blow-molded from an elastomer plastic and having a hollow bellows existing between a toe piece and a heel piece.

U.S. Pat. No. 5,291,669 discloses a shoe preserver having a wicking portion and an absorbing portion retained within a flexible porous covering. The preserver is sized to substantially fill the volume defined by the interior of the shoe. A pair of preservers is interconnected by a flexible strap attached to the forward portion of the preserver such that upon insertion of the shoe, the shoe and preserver may be carried by the strap.

When buying expensive shoes, a custom-fitted shoe tree is sometimes, but very seldom, included. It is uncommon when buying women's shoes to receive a shoe tree; instead, most shoe purchases come with the paper tissue stuffers. Thus, shoe trees are often purchased aftermarket.

For this purpose, many types of shoe trees are being sold commercially. They come in two basic types: one-size shoe trees, and adjustable shoe trees. Within these types, there are more specialized versions, also based on the type of material used. Shoe trees may be constructed of wood or plastic. Since wooden-type shoe trees are solid, they may not fit a shoe perfectly and may extend the shape of the shoe. Moreover, wooden shoe trees may have a spring mechanism that is breakable, and they are not machine-washable, if washable at all.

Plastic shoe trees have some advantages. They are easy to obtain, as they are sold in a multitude of stores. They are inexpensive, and can be replaced easily (since they are often easily breakable). As to their quality, however, plastic shoe trees do not offer an effective shoe forming quality. Overall, shoe trees made of a more solid, harder material will stretch out the shape of the shoes rather than preserving the existing original form.

In general, existing shoe trees are difficult to handle. Particularly, they are difficult to be inserted into or pulled out of the shoes. The cedar models might damage the delicate ladies' shoes due to their solid construction. The softer models may lack durability and could lose their shape-holding function. They also lack decorative features that could enhance the appearance of the shoes.

Accordingly, there is an established need for a convenient and fashionable shoe stuffing device that can provide decorative features to enhance the appearance of the shoes, and that can also be easily inserted inside the shoes to protect the shape of the shoes or pulled out of the shoes for cleaning and storage, the shoe stuffing device being preferably machine-washable.

SUMMARY OF THE INVENTION

The present invention is directed to a convenient and fashionable shoe shape preserver, or shoe stuffing device, that can be easily inserted inside the shoes to preserve or protect the shape of the shoes, pulled out of the shoes for machine-washable cleaning and storage, and can also provide decorative features to enhance the appearance of the shoes. The shoe stuffing device can protect the shape of all kinds of men's and women's shoes, including women's flats, heels, wedges, wedding shoes, etc.

The shoe stuffing device provides a cushioned insert which can be easily stored in a closet or in a suitcase when traveling. Due to the softness of the shoe stuffing device, it easily adapts to a variety of shoe styles to fit perfectly and snuggly without stretching out the shoe. It molds to the shoe style to effectively preserve the shoe shape.

In a first embodiment of the present invention, the shape of the shoe stuffing device is constructed and arranged to fit to women's shoes. In a preferred embodiment, the shoe stuffing device has a top loop that can provide a handle for the user to grasp or insert the finger into and pull the shoe stuffing device out of the shoe. The top loop can include a small ring which can be made of plastic, metal, or any other suitably rigid material, embedded inside the shoe stuffing device, which is arranged around the top loop to maintain the round, loop shape of the top loop without pleating. The ring is preferably not exposed, but can be felt by the finger so that the top loop can be easily reached by the finger to pull the shoe stuffing device out of the shoe. The round, loop shape can be finished with a decorative element such as a small ribbon, tassel, jewel, or any other stylish elements to add a unique finishing touch. The decorative element not only provides a pleasant aesthetic effect, but also indicates to the user that the end having the ribbon or other decorative element is to remain outward, while the opposite end or tip is to be inserted into the shoe. The decorative element may vary, and may alternatively or additionally include beads, feathers, pearls or other decorations.

Introducing a first embodiment of the invention, the present invention consists of a shoe stuffing device, comprising: a shoe stuffing device body having a distal end and a proximal end and a top loop formed close to the proximal end.

In a second aspect, the shoe stuffing device body can include a ring around the top loop for maintaining the round, loop shape of the top loop and to avoid pleating of the fabric.

In another aspect, the ring can be arranged inside the body.

In another aspect, the ring can be generally rigid.

In another aspect, the shoe stuffing device body can have a shape of a drop or a shape similar to a heart when viewed from the front.

In another aspect, the shoe stuffing device body can have a rounded diamond shape when viewed from the side.

In another aspect, the shoe stuffing device can be made in many kinds of fabric of any color, pattern or combinations thereof with raw, preferably organic cotton inner filler. Preferably, the shoe stuffing device is machine washable.

In another aspect, the shoe stuffing device can further include a decorative element at the proximal end and attached to the top loop.

In another aspect, the decorative element can be a ribbon.

In another aspect, the decorative element can include a tassel, beads, feathers, pearls or other decorations, for instance and without limitation.

Accordingly, it is a primary objective of the instant invention to provide a shoe stuffing device which protects a user's shoes by supporting the shape of the shoe when it is not being worn.

It is a further objective of the instant invention to provide a shoe stuffing device which absorbs moisture from a shoe.

It is yet another objective of the instant invention to provide a shoe stuffing device with a decorative element such as a bow or jewel on one end.

It is further an objective of the instant invention to provide a shoe stuffing device which is stitched to constrain vertical expansion of the device so as to produce more support to a shoe in a lateral plane.

It is a still further objective of the instant invention to provide a shoe stuffing device which is machine washable.

Other objects and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Shown throughout the figures, the present invention is directed toward a convenient and fashionable shoe stuffing device that is capable of being easily inserted inside the shoes to protect the shape of the shoes or pulled out of the shoes for cleaning or when wearing the shoes, and is also capable of providing decorative features to enhance the appearance of the shoes.

Figure 1:
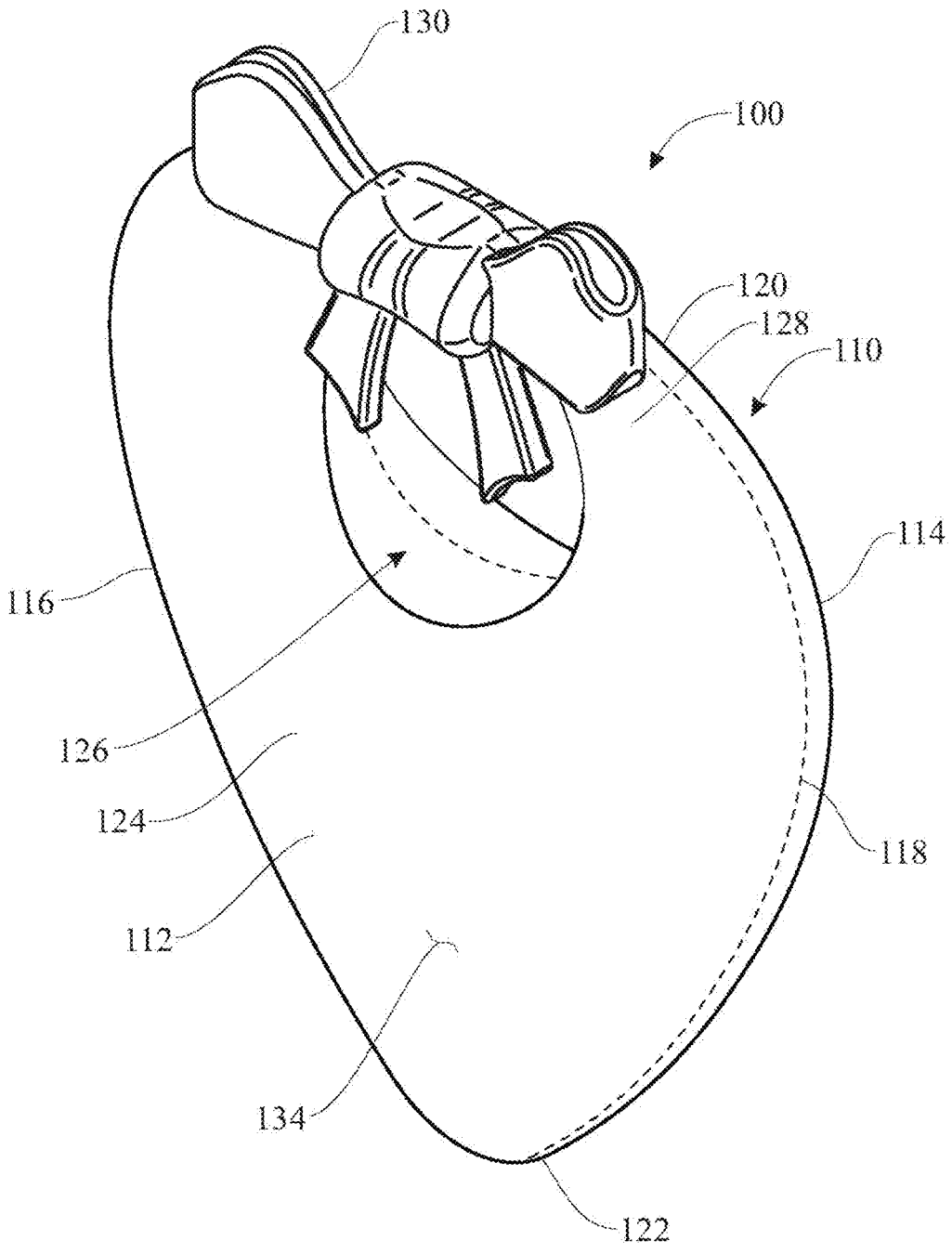
FIG. 1 is a top front perspective view of a shoe stuffing device in accordance with a first embodiment of the present invention.
Figure 2:
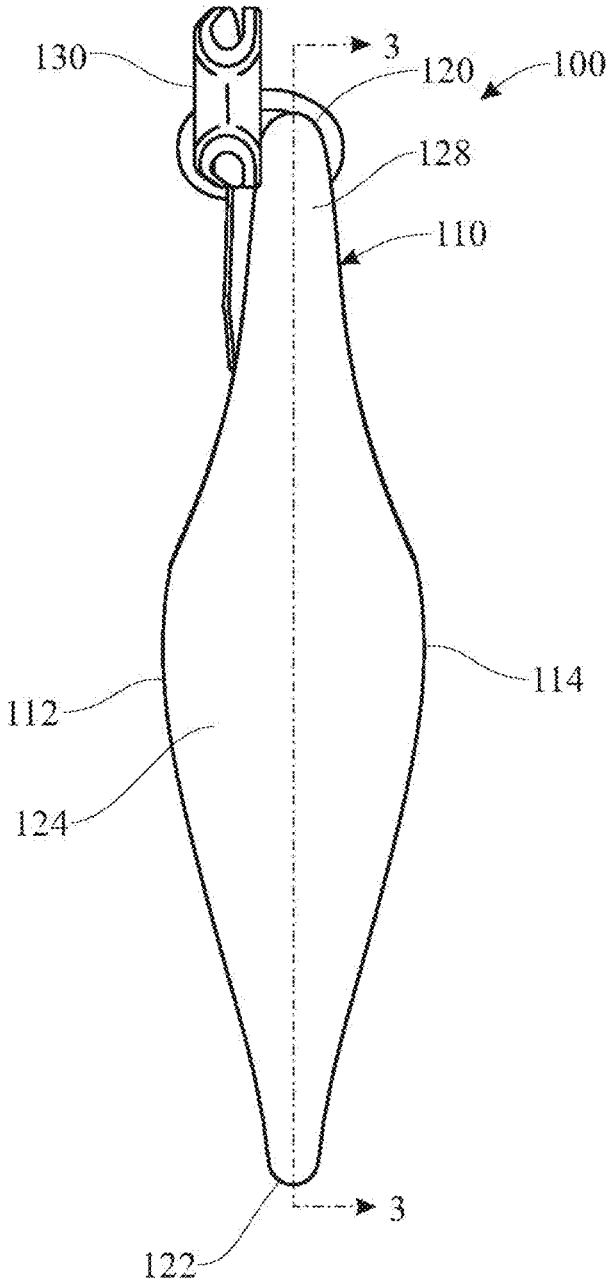
FIG. 2 is a left-side view of the shoe stuffing device of FIG. 1.

Referring to FIGS. 1-2, a shoe stuffing device 100 is shown in accordance with a first embodiment of the present invention. As shown in FIG. 1, the shoe stuffing device 100 includes a shoe stuffing device body 110 having a top side 112, a bottom side 114, a right side 116, a left side 118, a proximal end 120, a distal end 122, and a middle section 124. A through hole 126 is formed in the shoe stuffing device body 110 between the middle section 124 and the proximal end 120. The shoe stuffing device body 110 forms a top loop 128 at the proximal end 120, surrounding the through hole 126.

The shoe stuffing device 100 further includes a decorative element 130, such as a small ribbon, at or near the proximal end 120. The decorative element 130 can be attached to the top loop 128 or otherwise secured to said proximal end 120. As shown in FIGS. 1-5, in one embodiment, the decorative element 130 can be a ribbon secured to the top loop 128. The decorative element 130 not only provides a pleasant aesthetic effect, but also provides a visual indication to the user of how to place the shoe stuffing device 100 inside a shoe. Specifically, the user intuitively perceives that the proximal end 120 having the decorative element 130 is to remain outward while the opposite end, or distal end 122, is to be inserted into the shoe. The decorative element 130 may vary, and may alternatively or additionally include a tassel, beads, feathers, pearls, jewels, or other decorations.

In some embodiments, the decorative element 130 is removably attachable to the shoe stuffing device body 110, so that the decorative element 130 can be easily changed or replaced by the user to provide the shoe with different decorative features to match the user's different moods and/or fashion feelings. In this way, one pair of shoes can practically provide the looks of multiple different pair of shoes so that the user can save money and feel fashionable.

The shoe stuffing device body 110 can include an outer cover or casing 134 made, for instance, of fabric of any color, pattern or combinations thereof. A filler material 136 such as, but not limited to, raw cotton, can be housed inside the casing 134 and render the shoe stuffing device body 110 generally plump and relatively stiff in order to stuff and preserve a shoe tip from deformation, as will be described in greater detail hereinafter.

Figure 3:
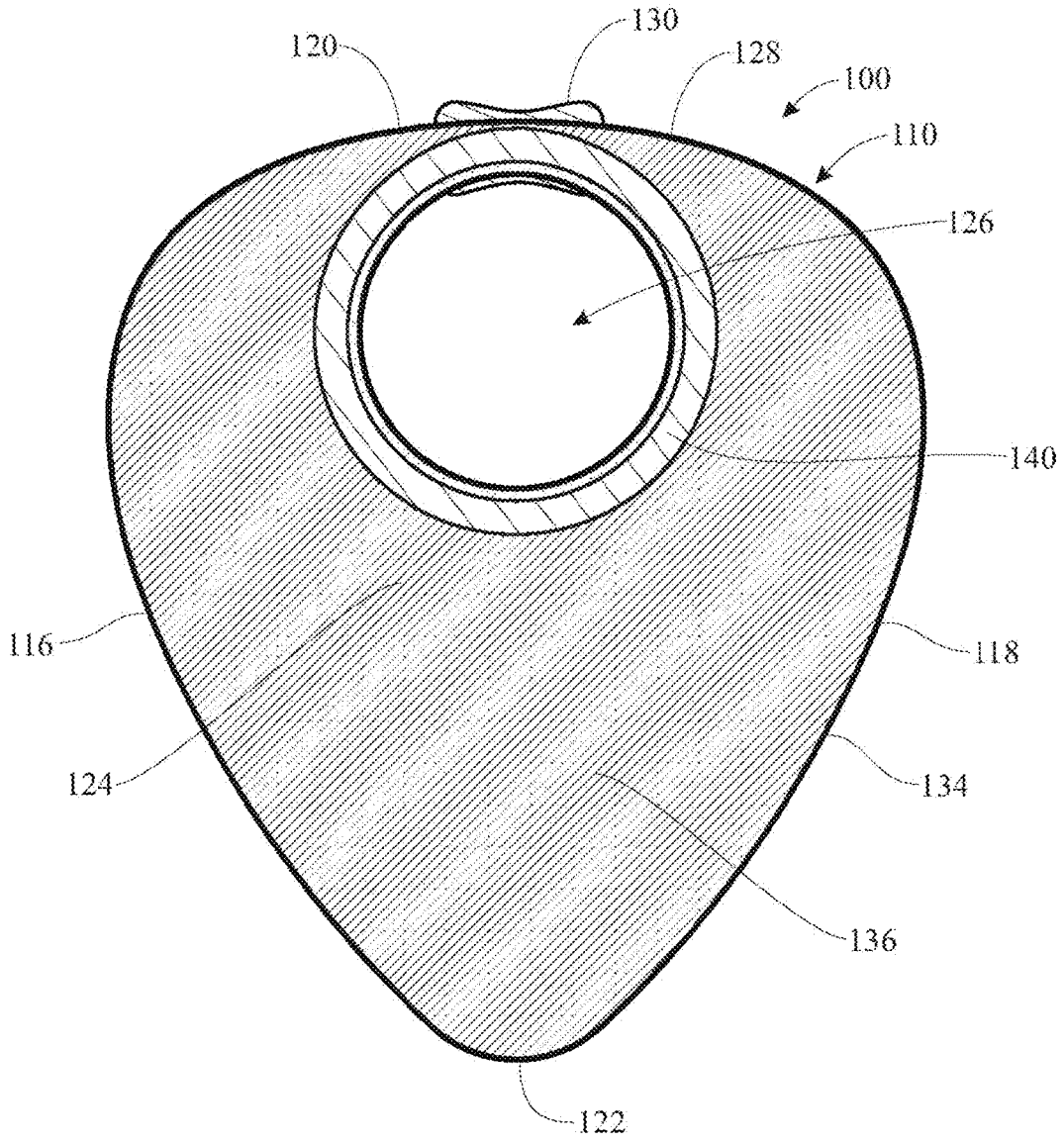
FIG. 3 is a cross-sectional view of the shoe stuffing device of FIG. 2, taken along line 3-3 of FIG. 2.

As can be seen in FIGS. 1 and 3, the shoe stuffing device body 110 can be generally shaped as an inverted drop (or similar to a guitar pick) when viewed from the top or bottom, where the proximal end 120 of the shoe stuffing device body 110 forms a wider end of the body and the distal end 122 of the shoe stuffing device body 110 forms a narrower and somewhat pointy (but preferably rounded) tip of the body. The inverted drop shape is aesthetically pleasant, and is constructed and arranged to correspond to the front area of a women's shoe.

As shown in FIG. 2, the shoe stuffing device body 110 can have an approximate shape of a rounded diamond shape when viewed from the side, where the shoe stuffing device body 110 has smaller thicknesses at the distal end 122 and the proximal end 120, and the largest thickness at a middle section 124. This rounded diamond shape is aesthetically pleasant, and is constructed and arranged to support the front area of a women's shoe.

FIG. 3 shows a cross-sectional view of the shoe stuffing device 100, taken between the top side 112 and bottom side 114. As shown, the shoe stuffing device body 110 can include an aperture 140 inside the body 110 through both the top and bottom sides 112, 114 of the device, and creating a top loop 128 on the proximal end 120. The aperture 140 can be made by attaching the top and bottom sides 112, 114 by sewing or other method to secure the top and bottom sides 112, 114 together without releasing the filler material 136 from within the outer cover or casing 134. The aperture 140 can also be reinforced with a solid object, such as a ring, to add reinforcement to the aperture to prevent tearing of the body 110 at the aperture 140, and provide a more secure portion for a user to grasp.

Figure 4:
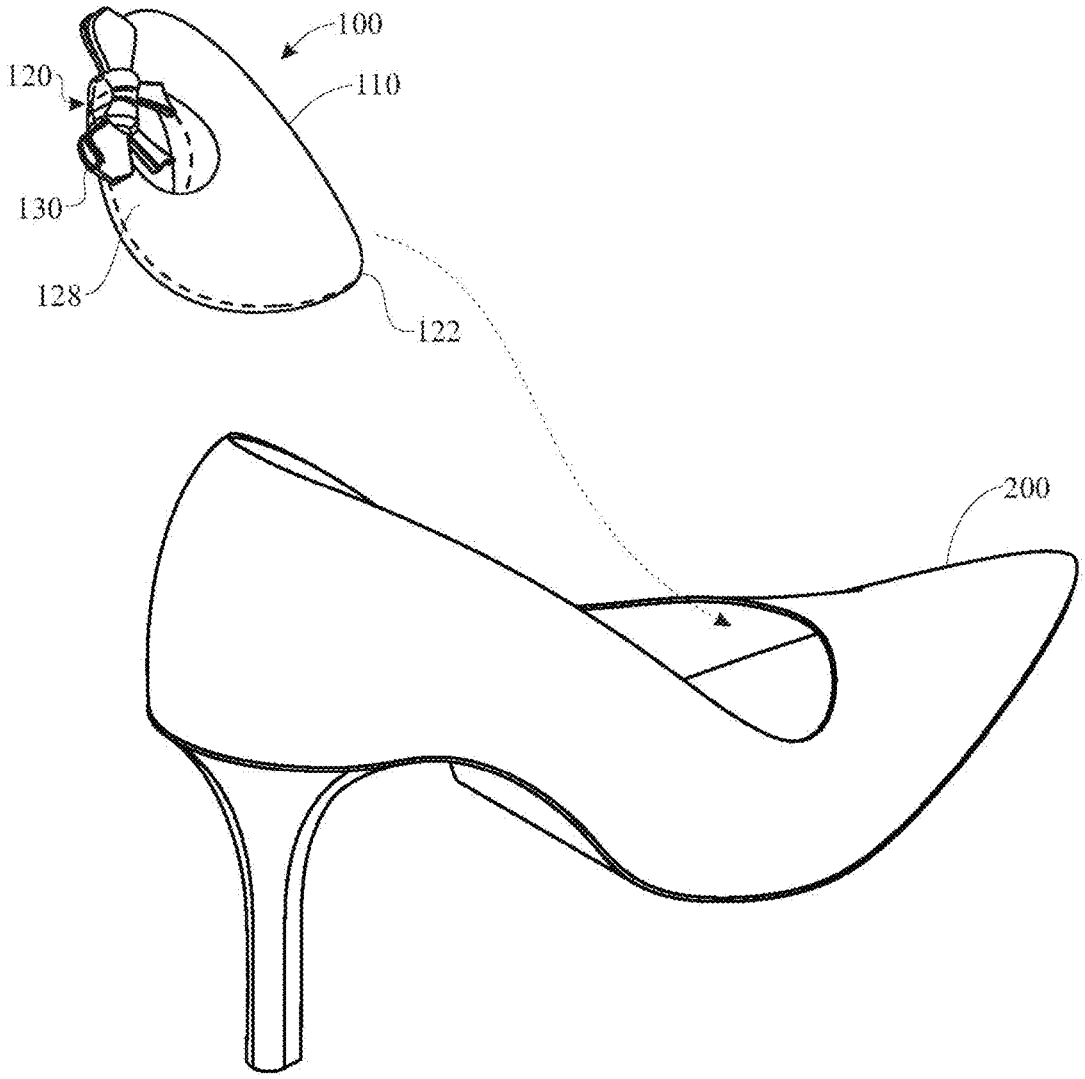
FIG. 4 is a perspective view of the shoe stuffing device of FIG. 1, indicating the direction of its insertion into a shoe.

Referring now to FIG. 4, the embodiment of the shoe stuffing device 100 shown in FIG. 1 is designed to be inserted into a women's shoe 200, as illustrated. A user can insert the shoe stuffing device 100 inside the shoe 200 by grasping the top loop 128 at the proximal end 120, and then inserting the shoe stuffing device 100 into the front area of the shoe 200. The decorative element 130 serves as guidance that the proximal end 120 is to remain outward while the opposite end, or distal end 122, is to be inserted into the shoe 200. The top loop 128 provides a handle for the user to grasp or insert the finger into and pull the shoe stuffing device 100 out of the shoe.

The aperture 140 facilitates inserting the shoe stuffing device 100 into the shoe 200. Specifically, when pushing the top loop 128 formed by the aperture 140 to insert the shoe stuffing device 100 into the shoe 200, the aperture 140 pushes on the filler material 136 extending between the aperture 140 and the distal end 122, and the shoe stuffing device 100 is easily moved into the shoe 200, regardless of the user only pushing on the top loop 128 at the distal end 122 of the shoe stuffing device body 110. Insertion is also facilitated by the shoe stuffing device body 110 having an inverted drop shape, as the distal end 122 being narrower greatly simplifies initially inserting the leading, distal end 122 into the shoe while the user holds the shoe stuffing device 100 from the proximal end 120. Additionally, the fact that the shoe stuffing device body 110 has an approximate shape of a rounded diamond shape when viewed from the side, i.e. that the shoe stuffing device body 110 has smaller thicknesses at the distal end 122 and the proximal end 120 and the largest thickness at the middle section 124, further facilitates inserting the shoe stuffing device 100 into the shoe 200. Specifically, the narrower proximal end 120 of the shoe stuffing device body 110 can be easily held by the user while inserting the narrower distal end 122 of the shoe stuffing device body 110 into the shoe 200. The thicker middle section 124 then fills the front area of the shoe 200, to prevent deformation of the shoe.

Figure 5:
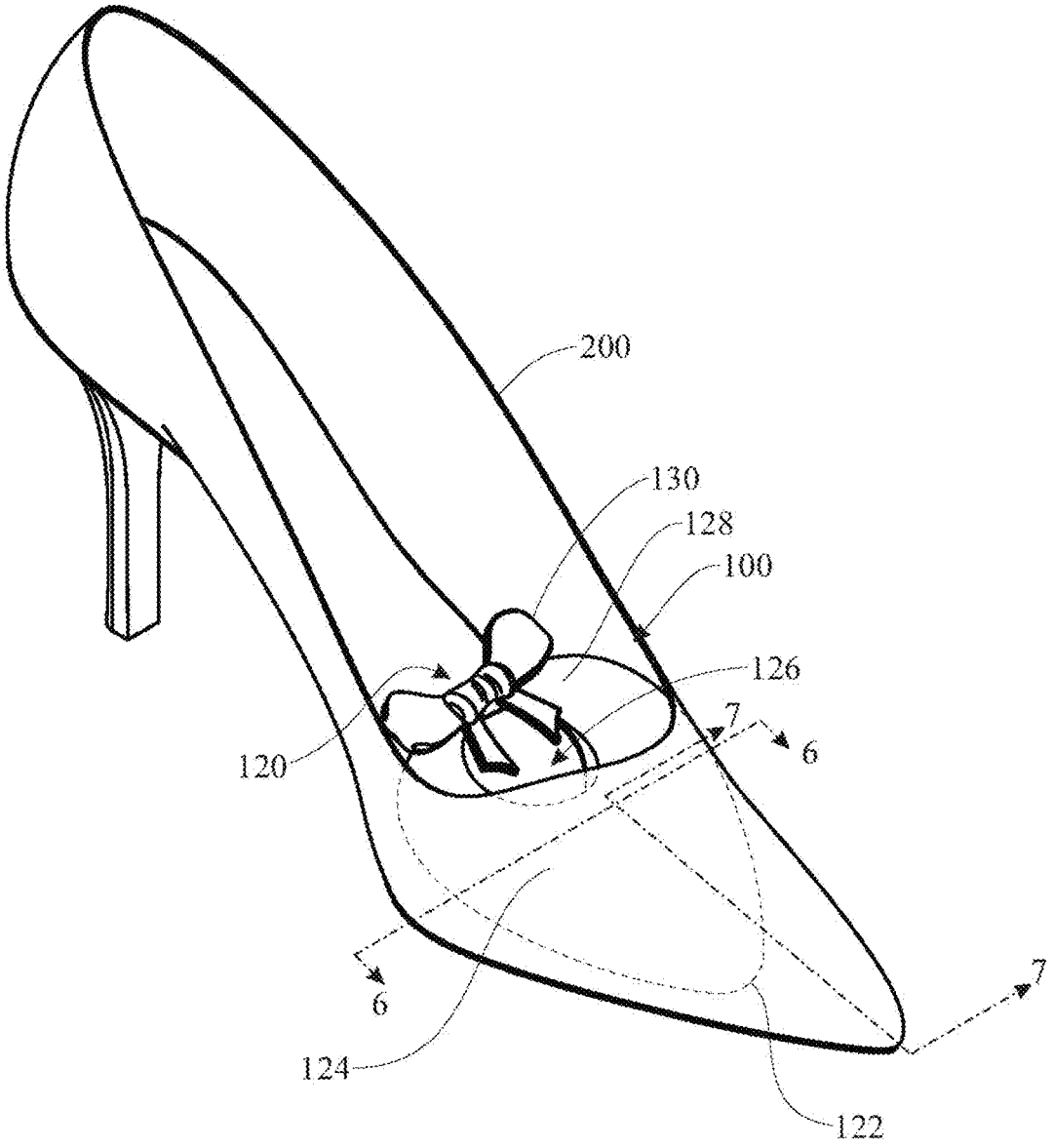
FIG. 5 is a perspective view of the shoe stuffing device of FIG. 1, while inserted into a women's high-heel shoe.
Figure 6:
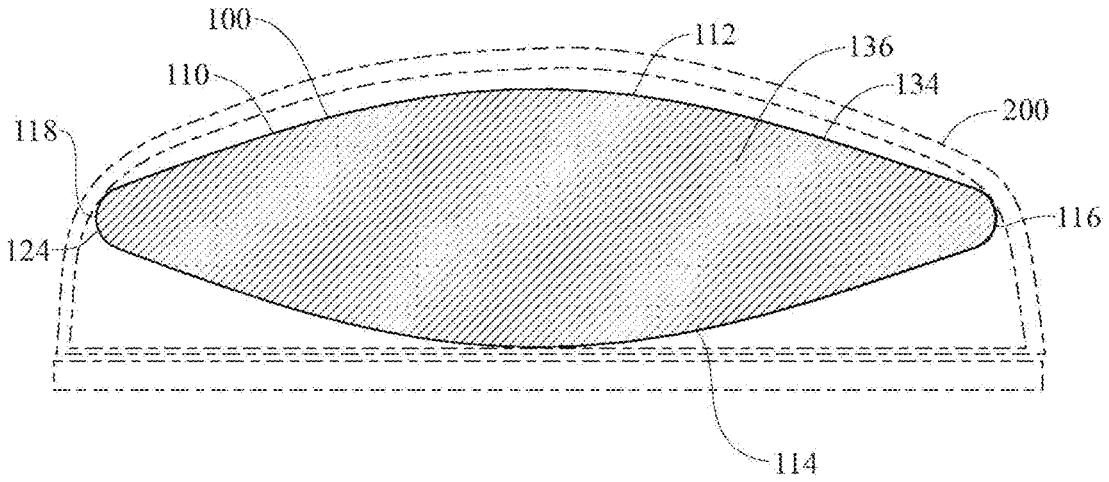
FIG. 6 is a cross-sectional view of the shoe stuffing device of FIG. 5, taken along line 6-6 of FIG. 5, including the environment of the shoe.
Figure 7:
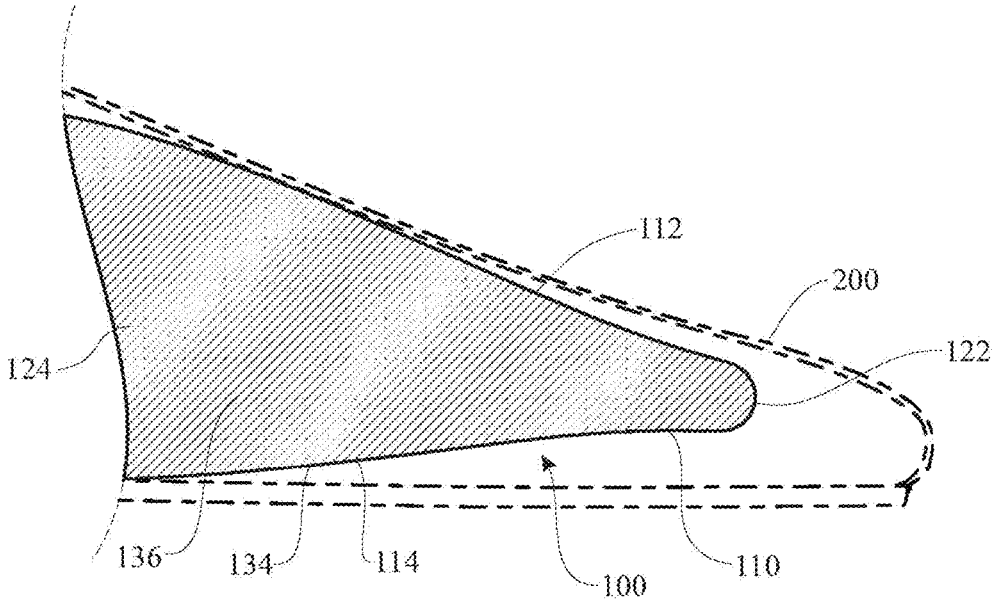
FIG. 7 is a partial cross-sectional view of the shoe stuffing device and environment of FIG. 5, taken along the line 7-7 of FIG. 5.
Figure 8:
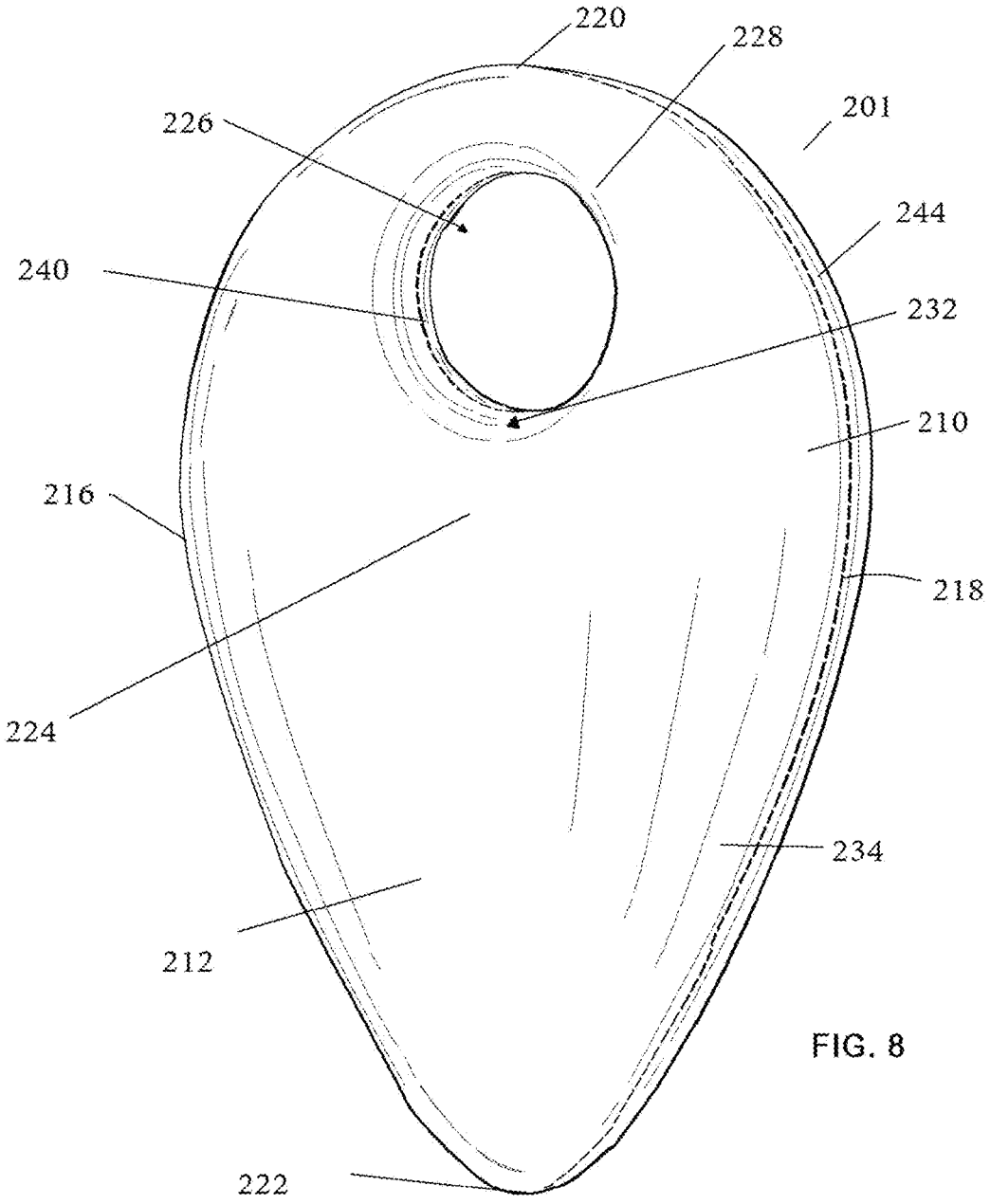
FIG. 8 is a top perspective view of an alternate embodiment of the shoe stuffing device.

FIGS. 5-7 show the shoe stuffing device 100 of FIG. 1 inserted inside the shoe 200 in an assembled, storage position. As shown in FIG. 6, the wider middle section 124 spans all or a majority of the width of the shoe 200, helping maintain the shape of the shoe 200. Similarly, as shown in FIG. 7, the thicker middle section 124 also spans all or a majority of the height of the shoe 200, further contributing to maintain the shape of the shoe 200. Furthermore, as shown in FIG. 5, the shoe stuffing device 100 in the final position can remain concealed in its practical entirety, except for the top loop 128 and the decorative element 130. The visible decorative element 130 provides a decorative feature for the shoe 200, and reminds the user that there is a shoe stuffing device 100 housed in the shoe 200 and that the user can remove the shoe stuffing device 100 by grasping the top loop 128.

Should the user wish to remove the shoe stuffing device 100 from the shoe 200, the user will pull the top loop 128 outward. A simple pulling action of the top loop 128 at the proximal end 120 of the shoe stuffing device body 110 causes the aperture 140 to efficiently pull the entirety of the shoe stuffing device 100 outwardly from the shoe, while keeping the shoe stuffing device 100 from deforming. The presence of the through hole 126 facilitates grabbing and pulling of the top loop 128, as the user can insert at least one fingertip in the through hole 126 to more easily secure the top loop 128 and apply a pulling force thereon.

FIGS. 8-17 show an alternate embodiment of the claimed shoe stuffing device. As shown in FIGS. 8-17, the shoe stuffing device 201 includes a body 210 formed from an outer covering 234 surrounding a filler material (not shown). The body 210 includes a top side 212, a bottom side 214, a right side 216, a left side 218, a distal end 222, a proximal end 220, and a middle section 224. As shown, the left and right sides 218, 216 taper from middle section 224 to the distal end 222, and the top and bottom sides 212, 214 taper from the middle section 224 to said distal end 222.

Figure 9:
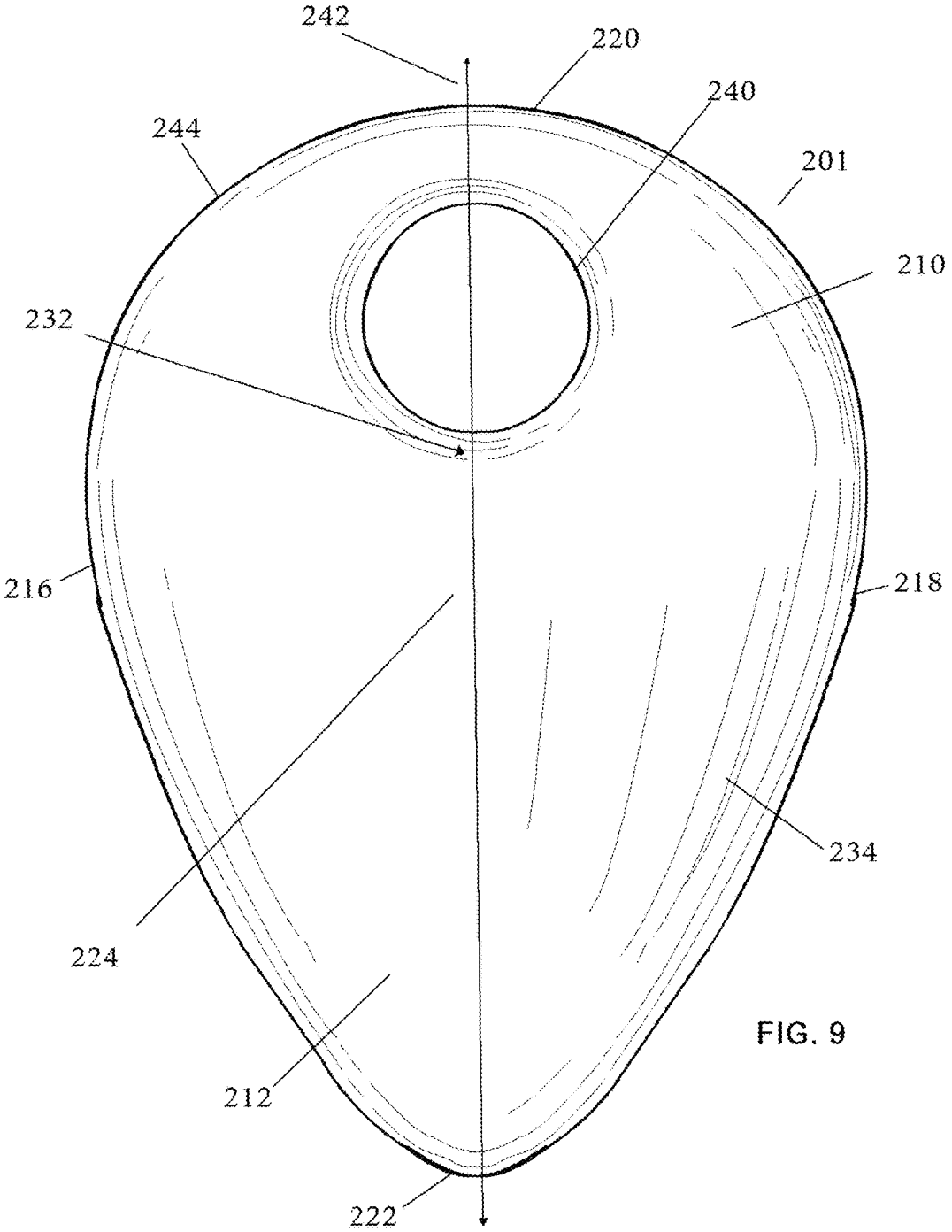
FIG. 9 is a top view of the shoe stuffing device of FIG. 8.
Figure 10:
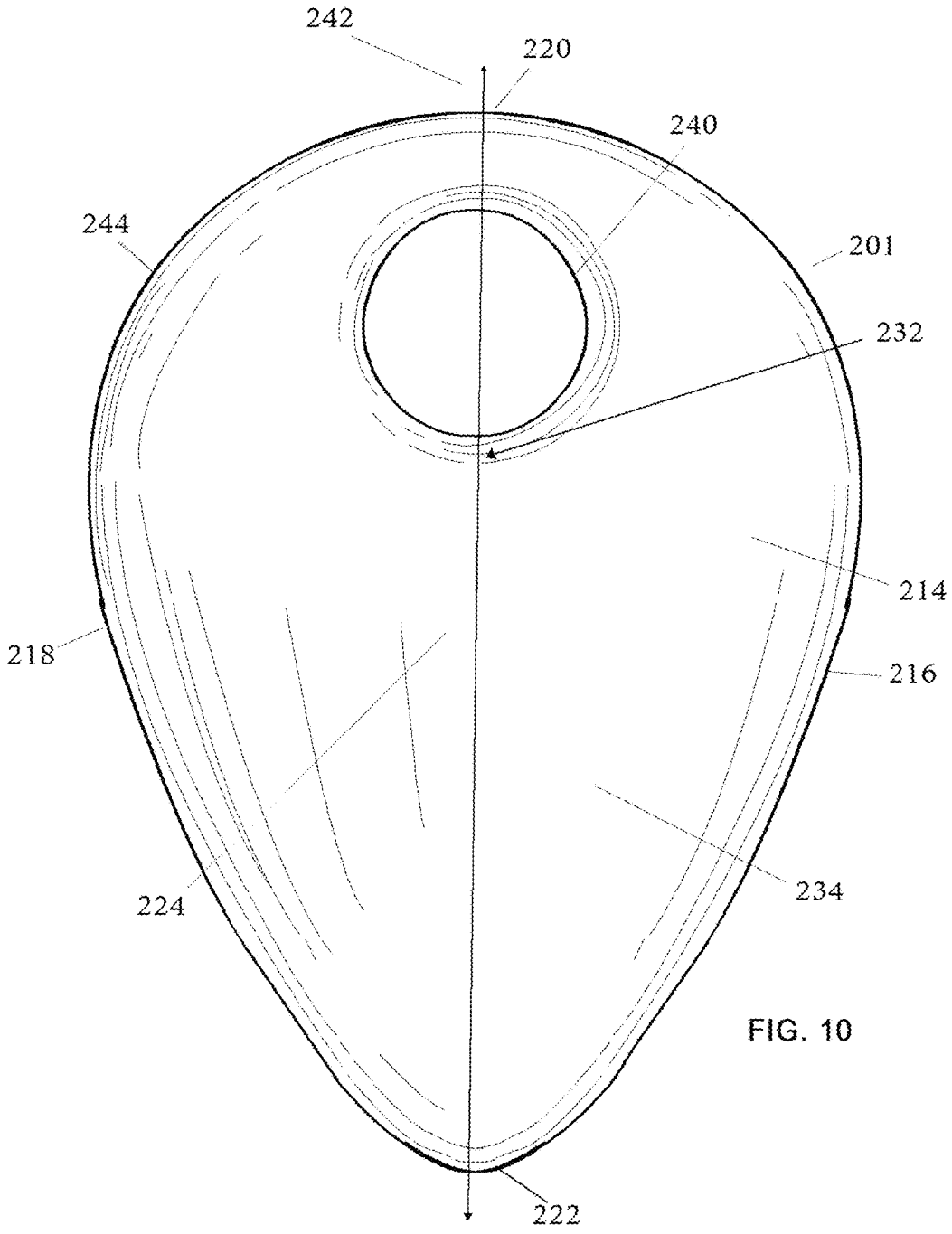
FIG. 10 is a bottom view of the shoe stuffing device of FIG. 8.
Figure 11:
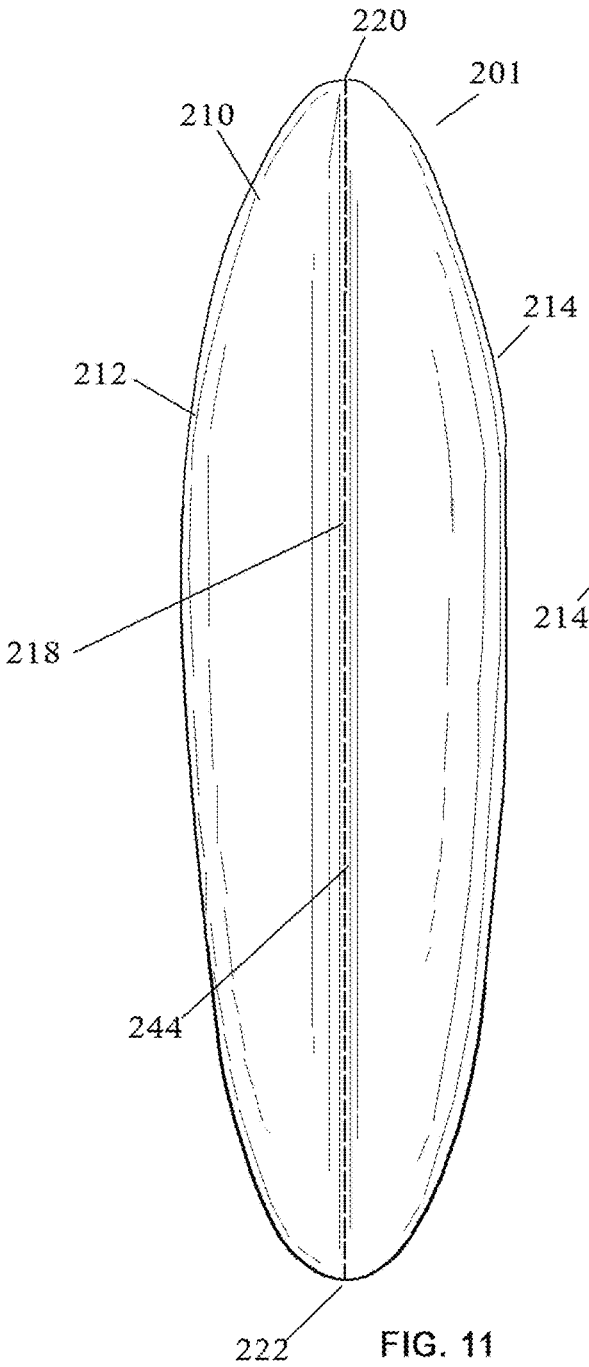
FIG. 11 is a left-side view of the shoe stuffing device of FIG. 8.
Figure 12:
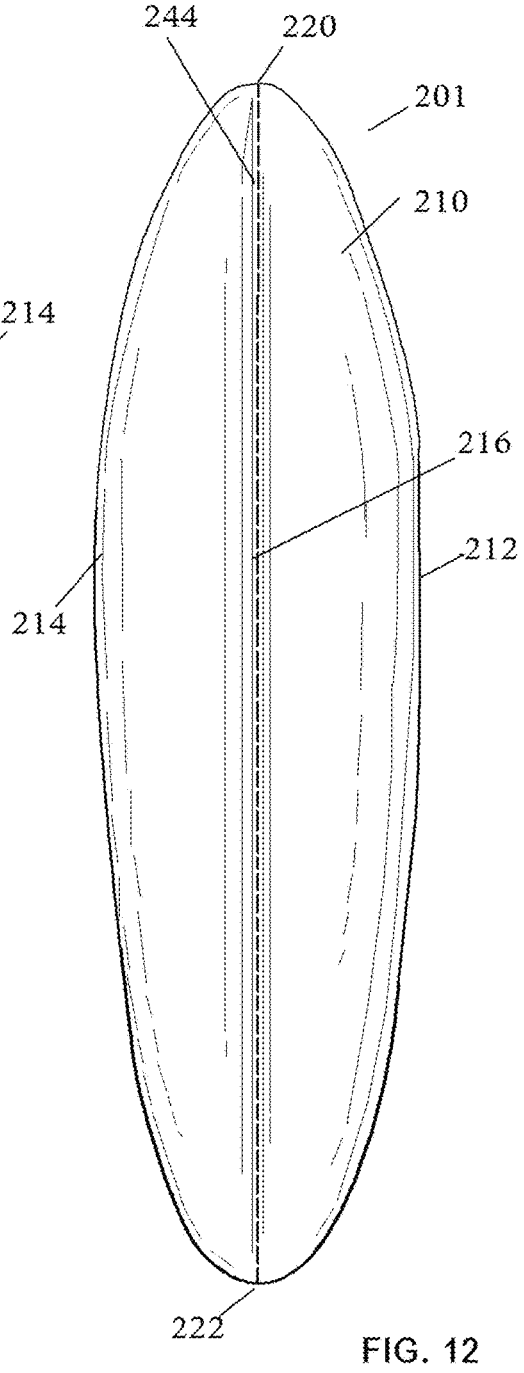
FIG. 12 is a right-side view of the shoe stuffing device of FIG. 8.
Figure 13:
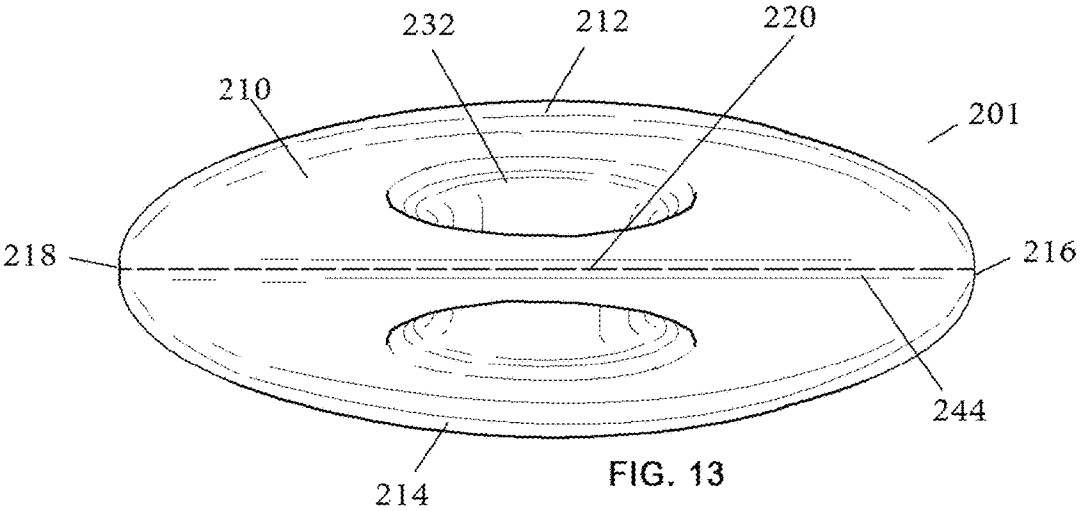
FIG. 13 is a back view of the shoe stuffing device of FIG. 8.
Figure 14:
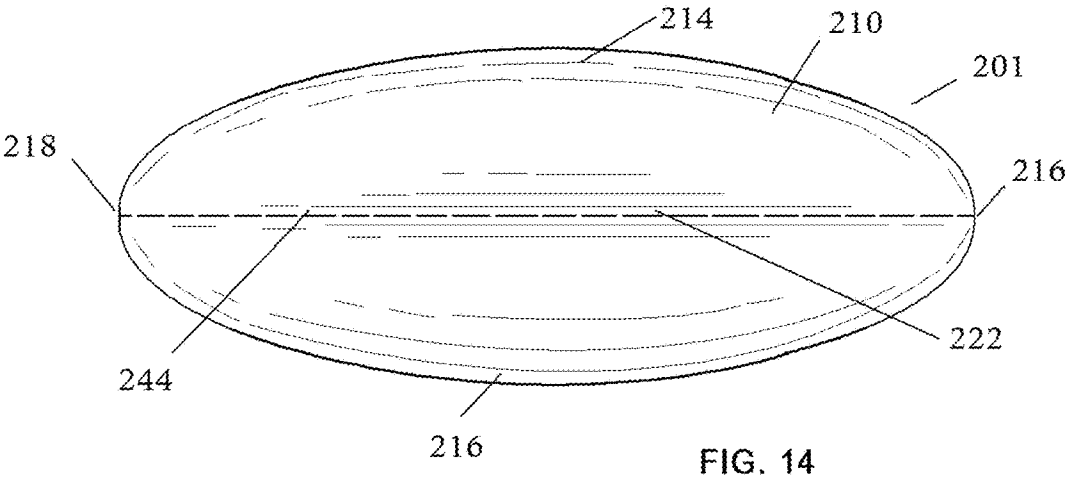
FIG. 14 is a front view of the shoe stuffing device of FIG. 8.
Figure 15:
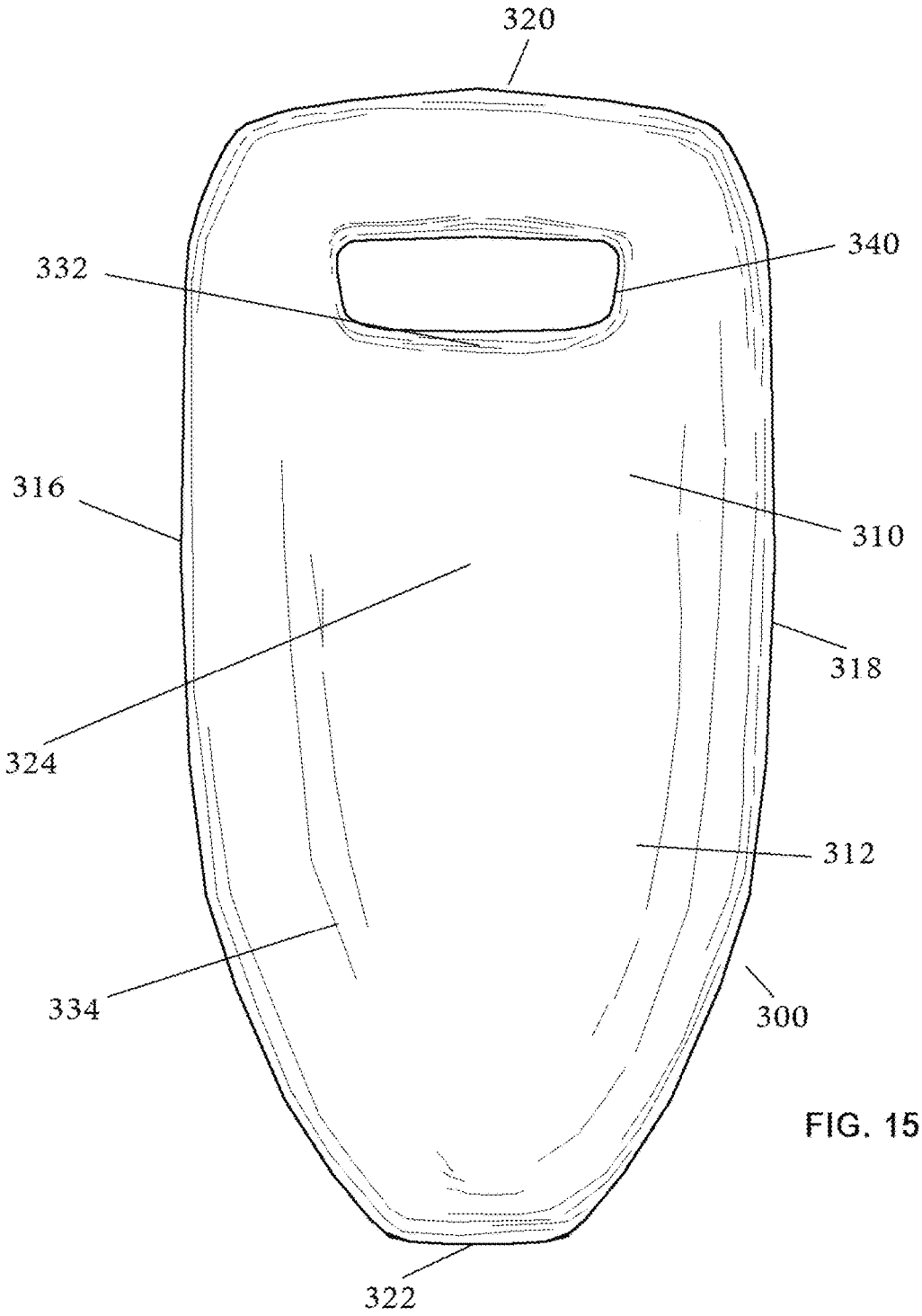
FIG. 15 is a top view of the shoe stuffing device of an alternate embodiment of the present invention.
Figure 16:
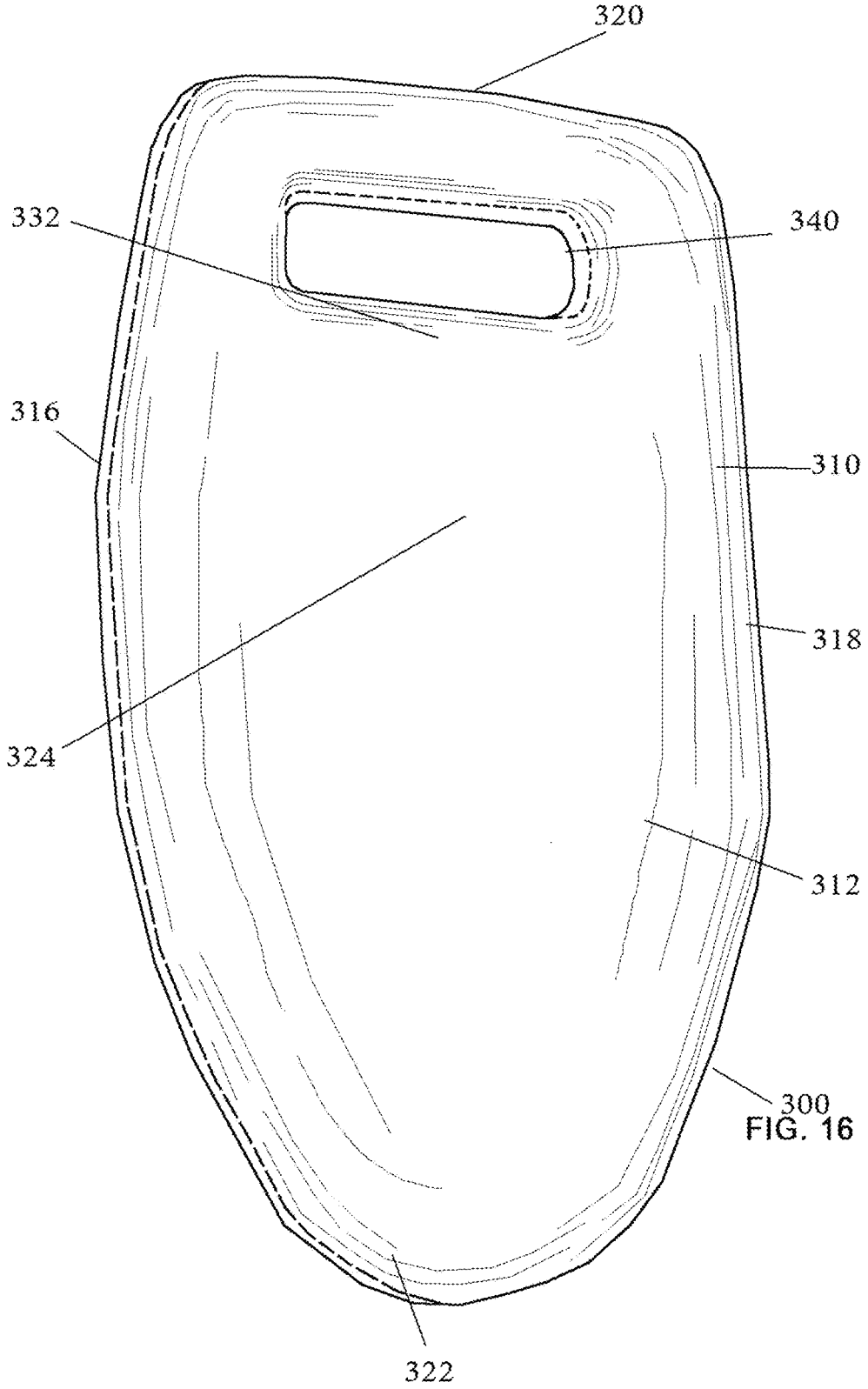
FIG. 16 is a top-right perspective view of the shoe stuffing device of FIG. 15.
Figure 17:
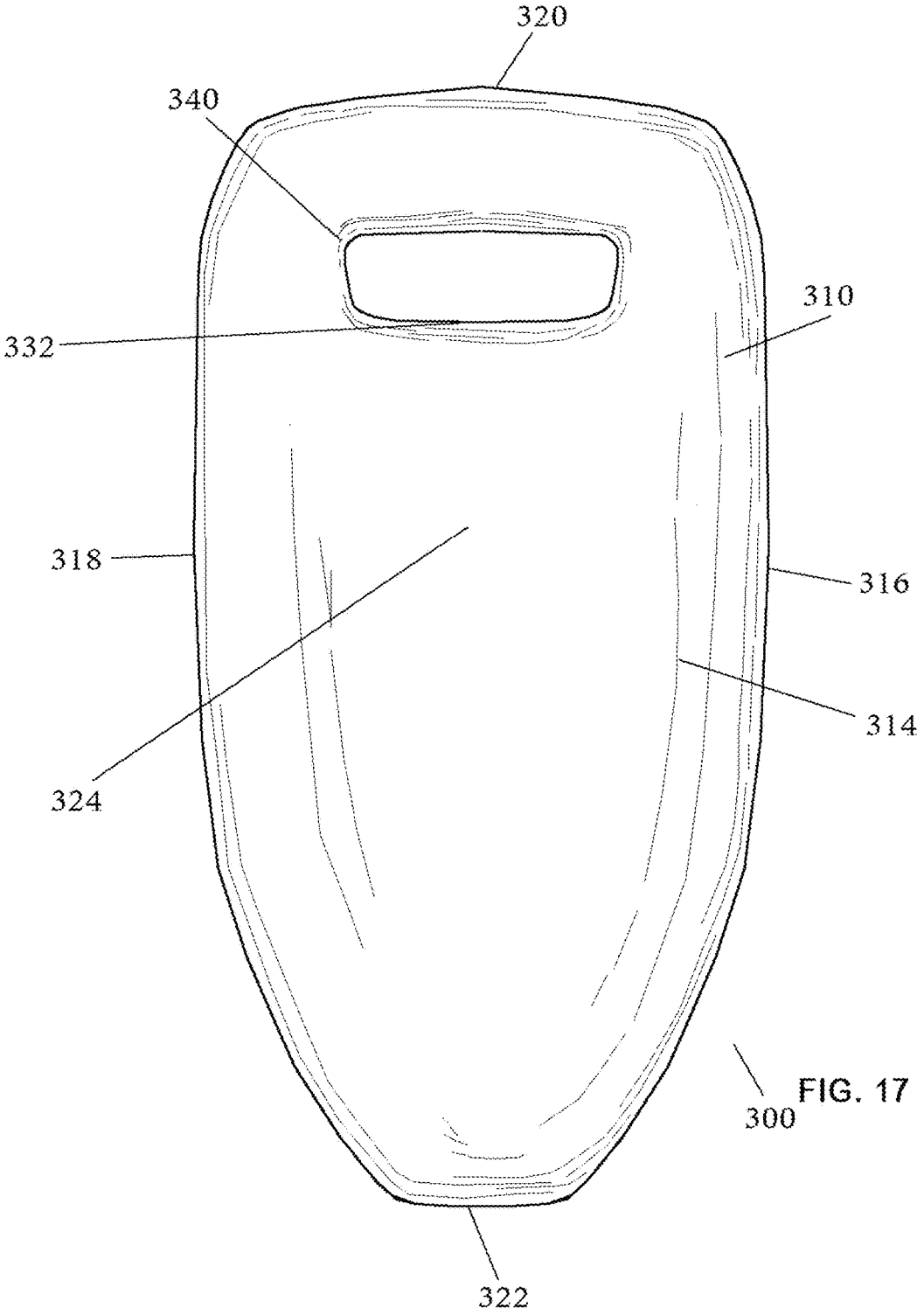
FIG. 17 is a bottom view of the shoe stuffing device of FIG. 15.
Figure 18:
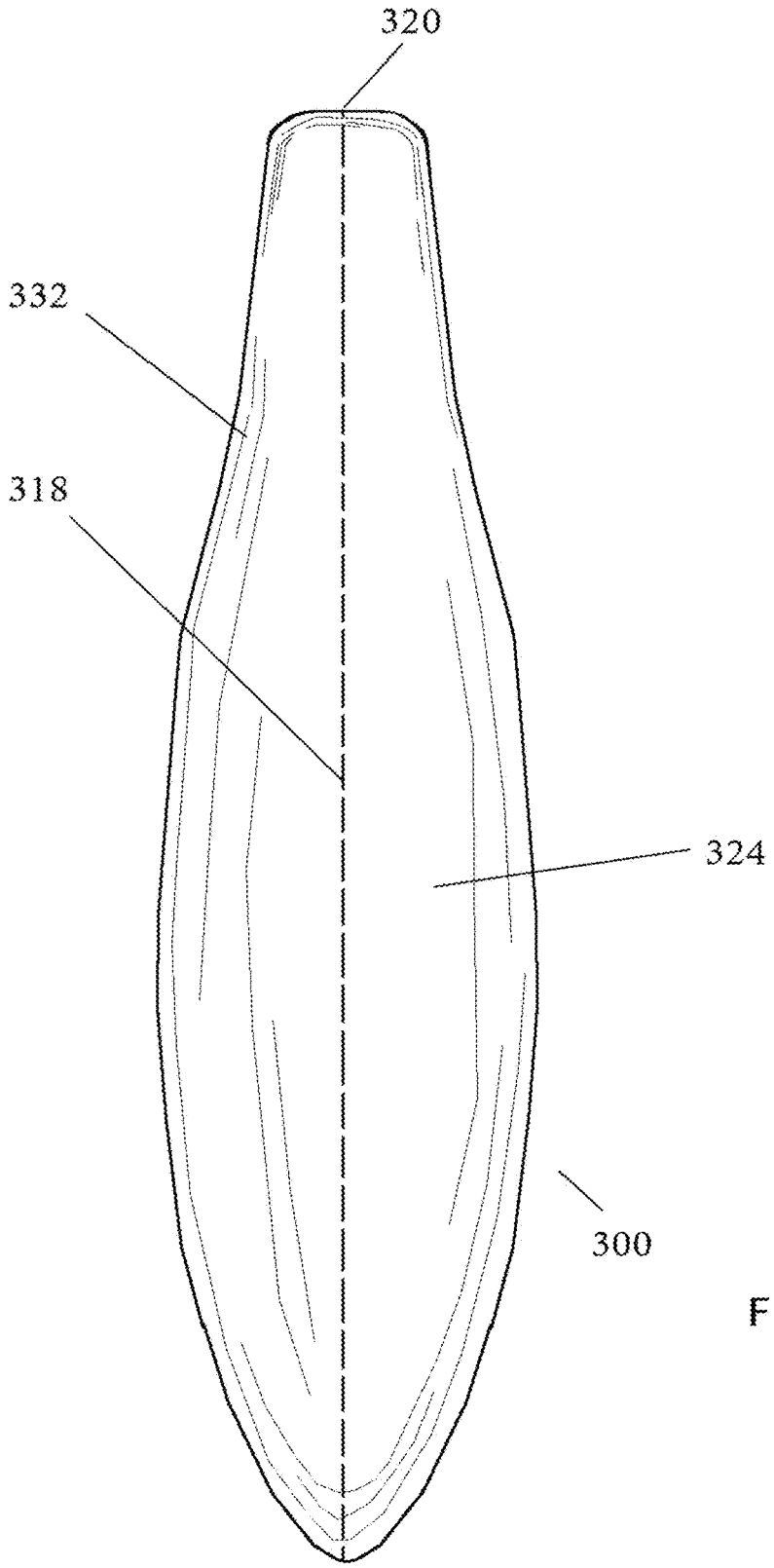
FIG. 18 is a left-side view of the shoe stuffing device of FIG. 15.
Figure 19:
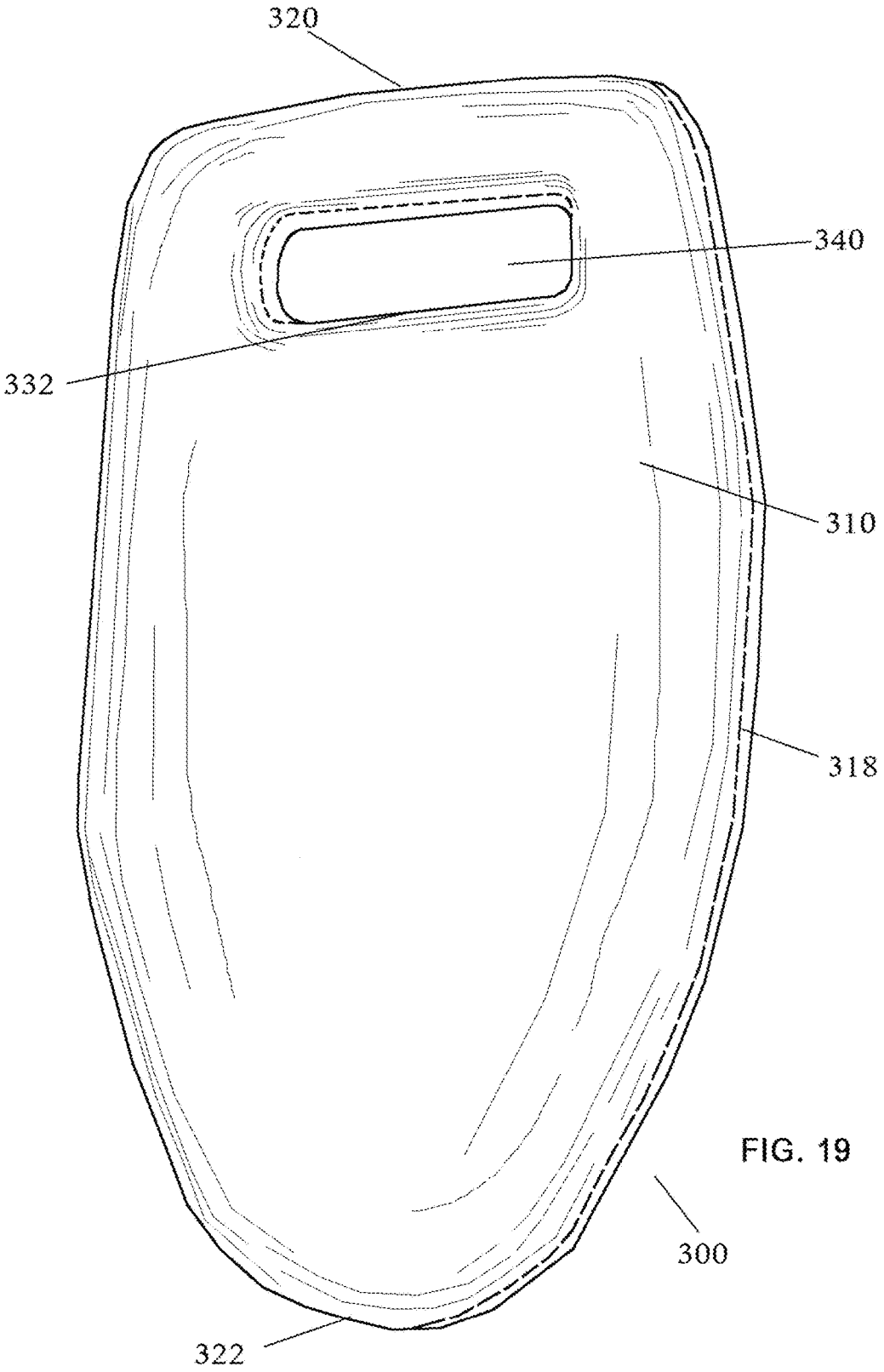
FIG. 19 is a top-left perspective view of the shoe stuffing device of FIG. 15.
Figure 20:
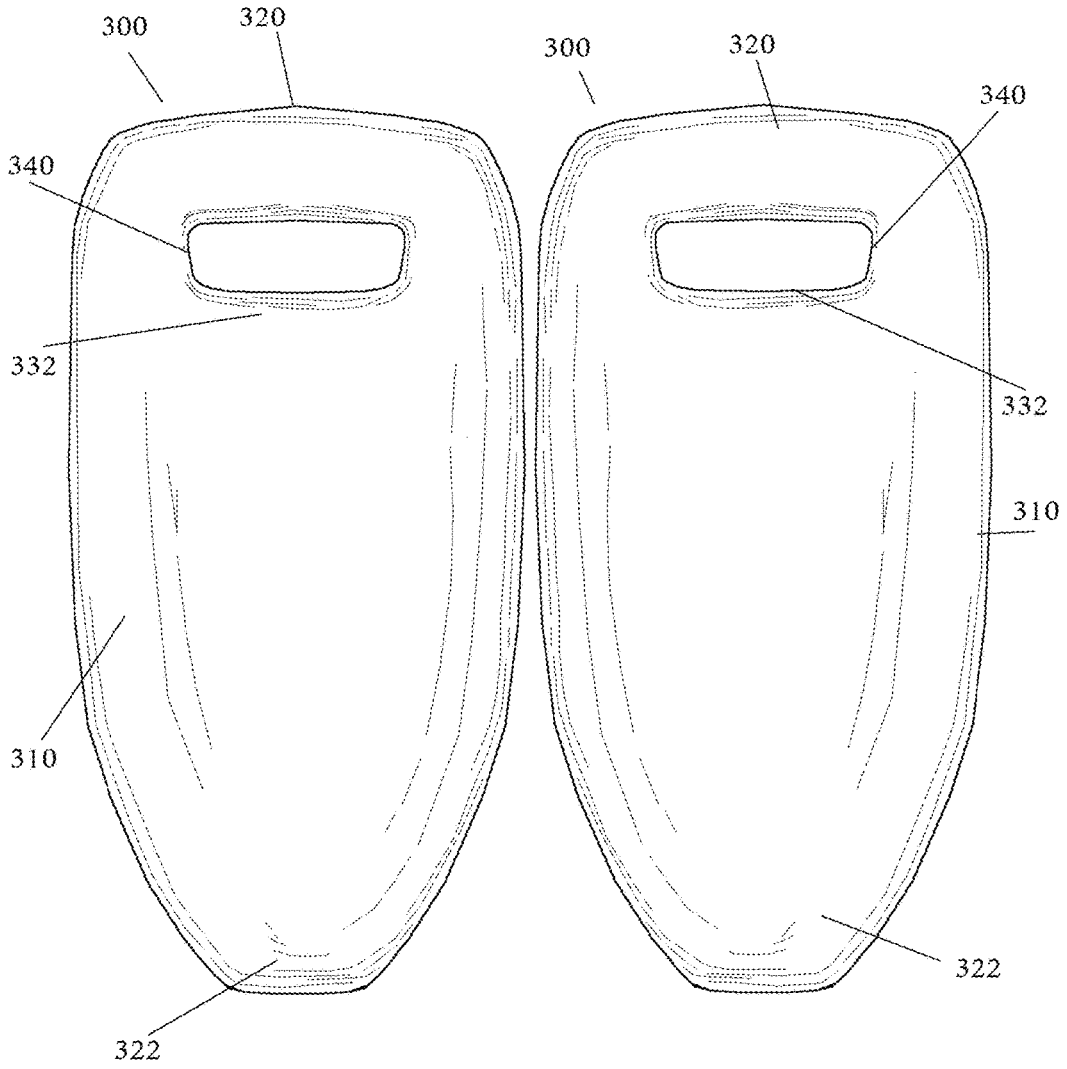
FIG. 20 is a top view of a pair of shoe stuffing devices of the embodiment shown in FIG. 15.
Figure 21:
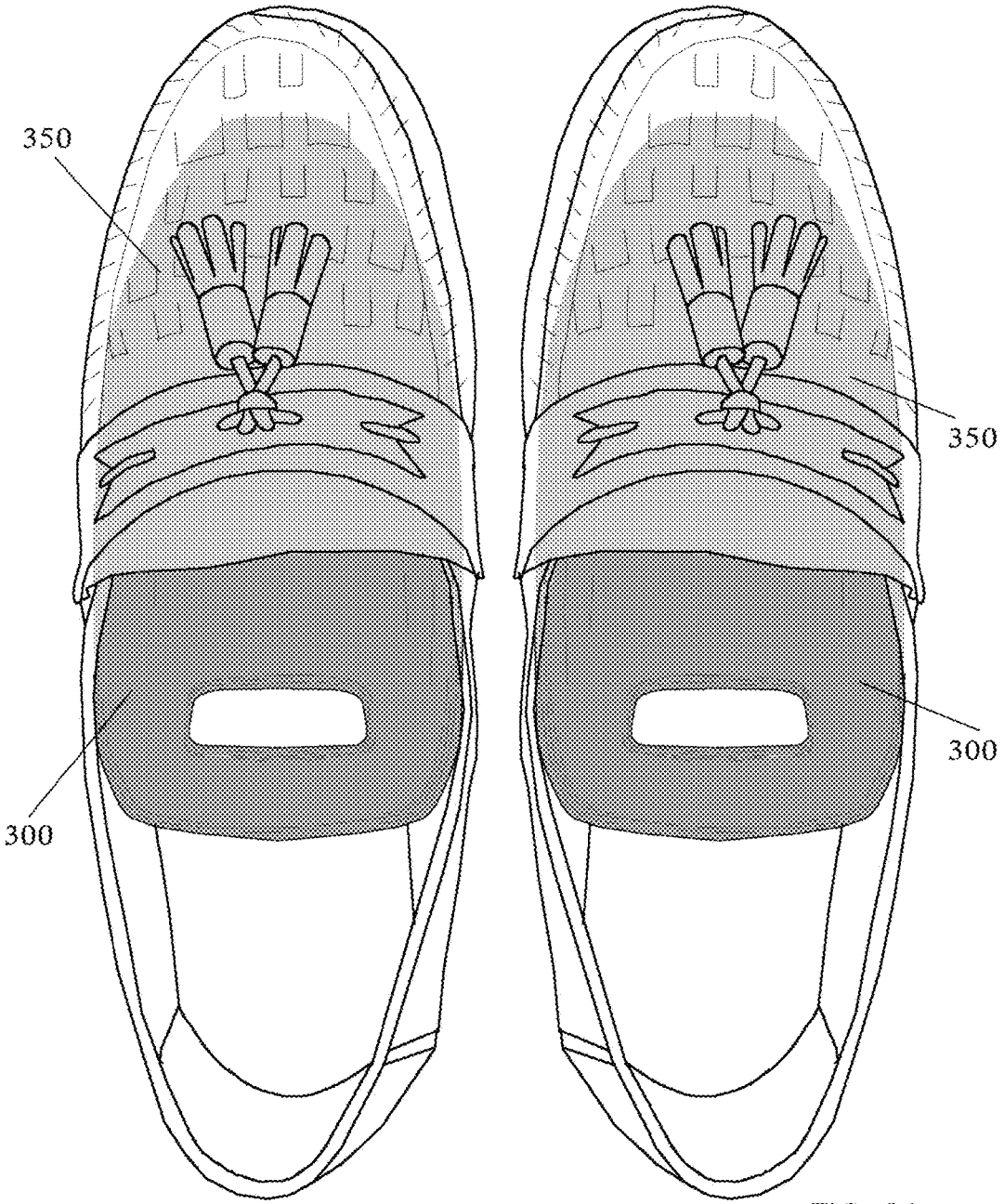
FIG. 21 is a top view of the shoe stuffing devices of FIG. 20 shown inserted into men's shoes.

The body 210 also includes an expansion restricting section 232, which restricts the body 210 from expanding in the vertical direction, i.e., expanding the top side 212 away from the bottom side 214. The expansion restricting section 232 is located between the middle section 224 and said proximal end 220. Additionally, the expansion restricting section 232 resists the compression of the left and right sides 218, 216 of the shoe stuffing 201 device in the front portion of the body, i.e., the portion between the distal end 222 and the expansion restricting section 232. As seen in FIGS. 9-10, the expansion restricting section 232 is located along a longitudinal axis 242, which extends from the proximal end 220 to the distal end 222.

A simple way of creating the expansion restricting section 232 is to include an aperture 240 in the body 210, extending through both the top and bottom sides 212, 214. By the covering 234 being secured inside the aperture 240, the top and bottom sides 212, 214 are held together in a region between the proximal and distal ends 220, 222. More desirable, the aperture 240 can be positioned between the middle section 224 and the proximal end 220 because of the increased width in the body 210 towards the middle section 224. By placing the expansion restricting section 232, shown here as an aperture 240, where the width is greater, the section 232 helps reinforce the lateral (between the left and right sides 218, 216) compressibility of the device 201, and prevent vertical (between the top and bottom side 212, 214) expansion.

Although an aperture 240 is shown as the expansion restringing section 232, alternate devices can also be employed. In a simple embodiment, the expansion restricting section can be simply stitching between the top and bottom side 212, 214 to hold them together. Alternately, an object, such as a ring or other object, can be employed within the body 210 and secured to both the top and bottom sides 212, 214 to achieve the same function.

In making the body 210 machine washable, it is desirable for the body 210 to be made of two pieces of machine washable fabric for the covering 234, which can be secured together along the perimeter 244 and at the expansion restricting section 232. One simple method of securing the top and bottom pieces of material can include sewing them.

Figure 22:
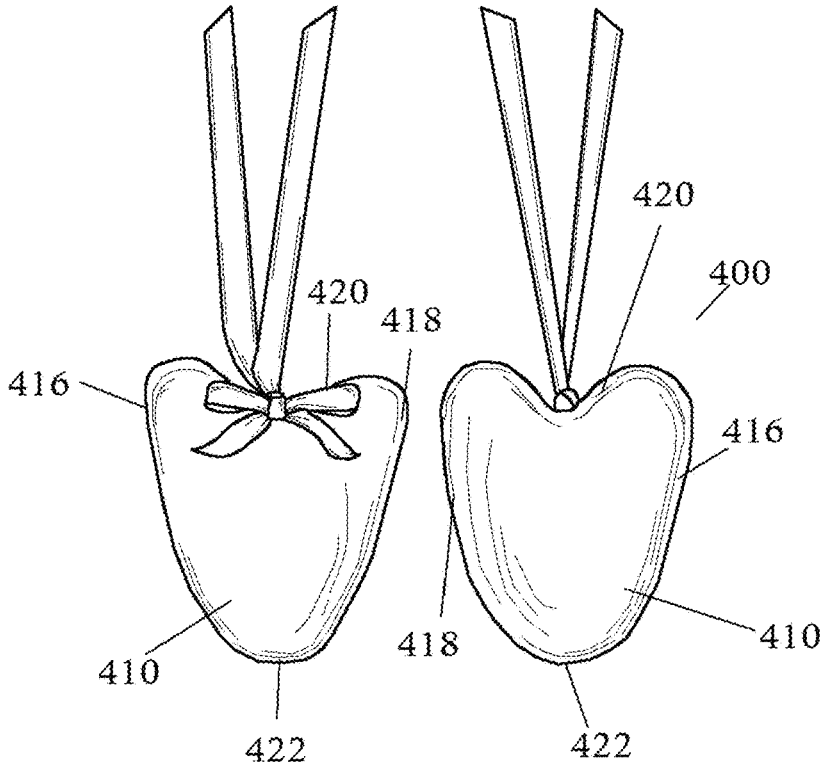
FIG. 22 is a top view and bottom view of a pair of an alternate embodiment shoe stuffing device with a cordate shaped body.
Figure 23:
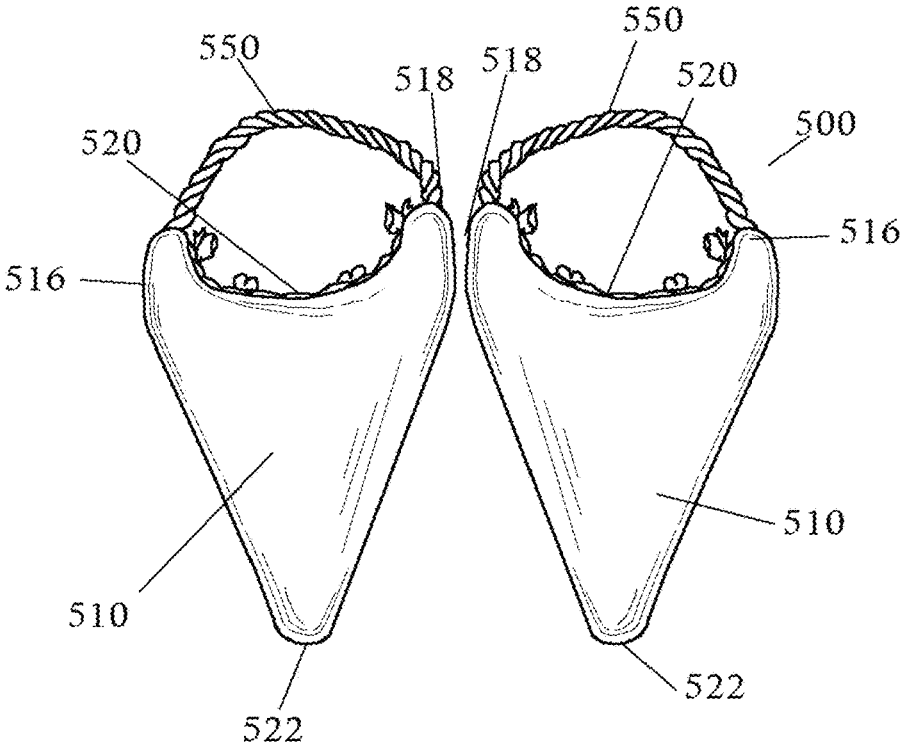
FIG. 23 is a top view and bottom view of a pair of a further embodiment shoe stuffing device with a cord attachment at the proximal end.
Figure 24:
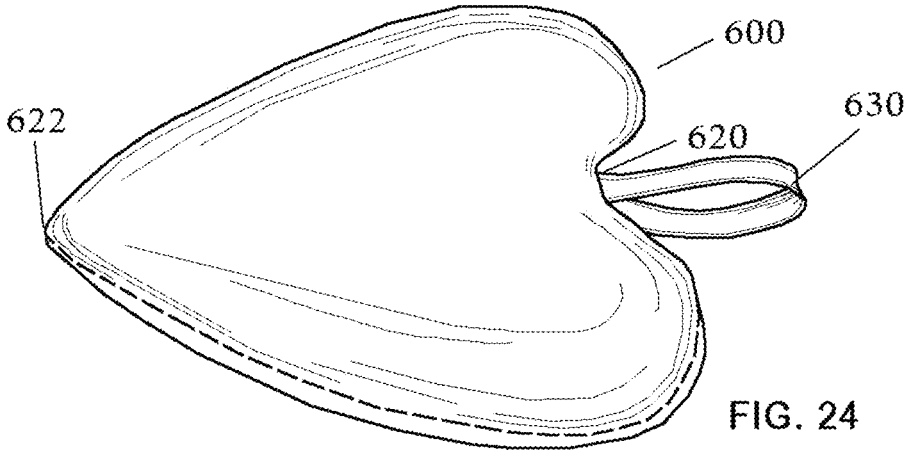
FIG. 24 is a top left perspective view of an alternate embodiment shoe stuffing device with a cordate shaped body.
Figure 25:
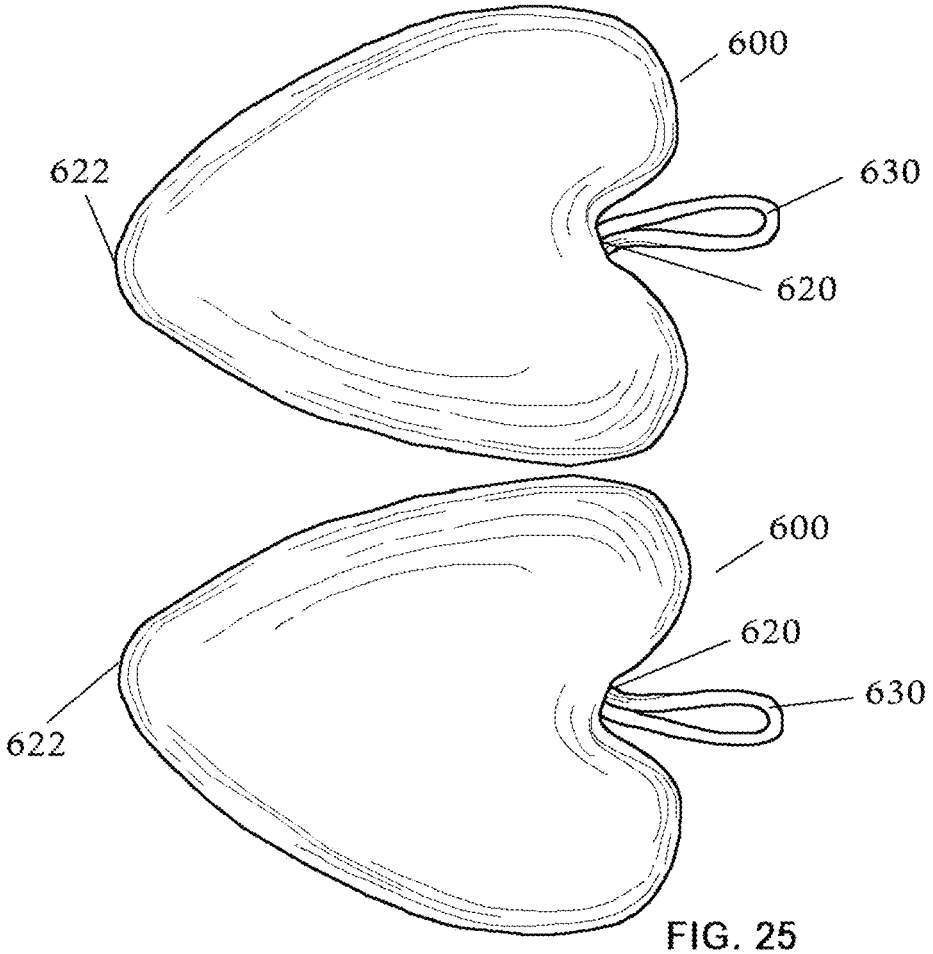
FIG. 25 is a top view of a pair of the shoe stuffing device of FIG. 24.

In a further embodiment of the shoe stuffing device 400, shown in FIG. 22, the body 410 can be formed in a cordate shape, like a leaf or heart-shape, where the proximal end 420 angles back toward the distal end 422, coming in from the left and right sides, 418, 416. With a general cordate shape, an alternate embodiment of the shoe stuffing device 500, shown in FIG. 23, can include a cord 550 coupled to the body 510 at the proximal end 520, where one end of the cord can couple to the left side 518 of the proximal end 520 and the other end can couple to the right side 516 of the proximal end 520. The cordate shape can be further seen in the alternate embodiment shoe stuffing device 600, shown in FIGS. 24-25. As shown, the cordate shape of the shoe stuffing device 600 bears resemblance to a heart, or leaf, shape when viewed from the top. The device 600 includes a decorative element 630, which can include ribbon or cord among other possible decorative elements previously described, on the proximal end 620 where the end tapers back towards the distal end 622.

In an alternate embodiment designed for men's shoes, shown in FIGS. 15-21, the shoe stuffing device 300 can include a rectangular aperture 340 based on the shoe stuffer having a wider body 310 due to the relatively larger width of men's shoes 350 as compared to women's shoes. As shown, the shoe stuffing device 300 includes a body 310, made of a covering 334 surrounding a filler material (not shown).

The body 310 includes a top side 312, a bottom side 314, a right side 316, a left side 318, a distal end 322, a proximal end 320, and a middle section 324. As shown, the left and right sides 318, 316 taper from middle section 324 to the distal end 322, and the top and bottom sides 312, 314 taper from the middle section 324 to the distal end 322.

The body 310 also includes an expansion restricting section 332, which restricts the body 310 from expanding in the vertical direction, i.e., expanding the top side 312 away from the bottom side 314. The expansion restricting section 332 is located between the middle section 324 and the proximal end 320. Additionally, the expansion restricting section 332 resists the compression of the left and right sides 318, 316 of the shoe stuffing device 300 in the front portion of the body, i.e., the portion between the distal end 322 and the expansion restricting section 332.

As shown in FIGS. 15-21, the expansion restricting section 332 is a rectangular aperture 340 in the body 310, extending through both the top and bottom sides 312, 314. Because of the increased width of the body 310 in this embodiment, it is beneficial for the aperture 340 to have a larger width than with previous embodiments to adequately constrain vertical expansion of the device 300 while reinforcing the lateral compressibility of the device.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A shoe stuffing device, comprising:

a shoe stuffing device body formed from an outer covering and a filling, said body having a top side, a bottom side, a left side, a right side, a distal end, a proximal end, and a middle section, said left and right sides tapering from said middle section to said distal end, said top and bottom sides tapering from said middle section to said distal end, said body having an expansion restricting section located between said middle section and said proximal end, said expansion restricting section restricting said shoe stuffing device from expanding towards said top and bottom sides, said expansion restricting section resisting compression of said left and right sides of said shoe stuffing device between said distal end and said expansion restricting section, said outer covering being made from a moisture-absorbent machine-washable fabric, and said filling made from a moisture-absorbent material, wherein said expansion restricting section is an annular region, said annular region located on a longitudinal axis of said shoe stuffing device, between said middle section and said proximal end.

2. The shoe stuffing device of claim 1, wherein said expansion restricting section is formed by securing said covering top and bottom sides at a point along a longitudinal axis of said shoe stuffing device, between said middle section and said proximal end.

3. The shoe stuffing device of claim 1, further comprising a decorative element on said proximal end.

4. The shoe stuffing device of claim 3, wherein said decorative element is a bow.

5. The shoe stuffing device of claim 3, wherein said decorative element is a charm.

6. The shoe stuffing device of claim 3, wherein said decorative element is a jewel.

7. The shoe stuffing device of claim 1, wherein said outer covering is formed from fabric.

8. The shoe stuffing device of claim 1, wherein said outer covering is formed from a top covering piece and a bottom covering piece, said top and bottom covering pieces being secured to each other along a perimeter of each.

9. The shoe stuffing device of claim 8, wherein said top and bottom covering pieces are secured along said perimeter of each by sewing.

10. The shoe stuffing device of claim 1, wherein said filling is cotton.

11. The shoe stuffing device of claim 1, further including a cord coupled to said proximal end, said cord having a first end and a second end, said cord first end coupled to said left side on said proximal end, said cord second end coupled to said right side on said proximal end.

12. A shoe stuffing device, comprising:

a shoe stuffing device body formed from an outer covering and a filling, said body having a top side, a bottom side, a left side, a right side, a distal end, a proximal end, and a middle section, said left and right sides tapering from said middle section to said distal end, said top and bottom sides tapering from said middle section to said distal end, said body having an expansion restricting section located between said middle section and said proximal end, said expansion restricting section restricting said shoe stuffing device from expanding towards said top and bottom sides, said expansion restricting section resisting compression of said left and right sides of said shoe stuffing device between said distal end and said expansion restricting section, said outer covering being made from a moisture-absorbent machine-washable fabric, and said filling made from a moisture-absorbent material, said expansion restricting section is formed by said body having a cordate shape, wherein said proximal end indents toward said distal end from said left and right sides towards a longitudinal axis of said shoe stuffing device.

13. A shoe stuffing device, comprising:

a shoe stuffing device body formed from an outer covering and a filling, said body having a top side, a bottom side, a left side, a right side, a distal end, a proximal end, and a middle section, said left and right sides tapering from said middle section to said distal end, said top and bottom sides tapering from said middle section to said distal end, said body having an expansion restricting section located between said middle section and said proximal end, said expansion restricting section restricting said shoe stuffing device from expanding towards said top and bottom sides, said expansion restricting section resisting compression of said left and right sides of said shoe stuffing device between said distal end and said expansion restricting section, said outer covering being made from a moisture-absorbent machine-washable fabric, and said filling made from a moisture-absorbent material, said expansion restricting section is a rectangular aperture through said top and bottom sides.

* * * * *